US008977156B2

(12) United States Patent
Yamamoto et al.

(10) Patent No.: US 8,977,156 B2
(45) Date of Patent: Mar. 10, 2015

(54) FIXING DEVICE AND IMAGE FORMING APPARATUS INCLUDING SAME

(71) Applicants: Takeshi Yamamoto, Kanagawa (JP); Kazuhito Kishi, Kanagawa (JP); Takumi Waida, Kanagawa (JP); Masahiro Samei, Osaka (JP); Hiroshi Ono, Tokyo (JP); Ippei Fujimoto, Kanagawa (JP); Hiroshi Seo, Kanagawa (JP); Ryota Yamashina, Kanagawa (JP); Yasunori Ishigaya, Kanagawa (JP)

(72) Inventors: Takeshi Yamamoto, Kanagawa (JP); Kazuhito Kishi, Kanagawa (JP); Takumi Waida, Kanagawa (JP); Masahiro Samei, Osaka (JP); Hiroshi Ono, Tokyo (JP); Ippei Fujimoto, Kanagawa (JP); Hiroshi Seo, Kanagawa (JP); Ryota Yamashina, Kanagawa (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/173,171

(22) Filed: Feb. 5, 2014

(65) Prior Publication Data

US 2014/0219673 A1 Aug. 7, 2014

(30) Foreign Application Priority Data

Feb. 6, 2013 (JP) ..... 2013-021735

(51) Int. Cl.
*G03G 15/20* (2006.01)

(52) U.S. Cl.
CPC .... *G03G 15/2042* (2013.01); *G03G 2215/2035* (2013.01)
USPC ..... 399/69; 399/122

(58) Field of Classification Search
USPC ..... 399/38, 67–70, 122, 320, 328, 329
See application file for complete search history.

(56) References Cited

U.S. PATENT DOCUMENTS

| | | | | |
|---|---|---|---|---|
| 5,402,220 | A | 3/1995 | Tanaka et al. | |
| 2008/0219718 | A1 * | 9/2008 | Fujita et al. | 399/307 |
| 2012/0230719 | A1 * | 9/2012 | Matsumoto | 399/69 |

FOREIGN PATENT DOCUMENTS

| | | |
|---|---|---|
| JP | 6-095540 | 4/1994 |
| JP | 6-138793 | 5/1994 |
| JP | 2001-343860 | 12/2001 |
| JP | 2004-284354 | 10/2004 |
| JP | 2005-181946 | 7/2005 |
| JP | 2010-044330 | 2/2010 |

OTHER PUBLICATIONS

Ceramics Archives 42 (2007), No. 1, pp. 54-56 (with Partial English Translation), 5 pages.

(Continued)

*Primary Examiner* — Hoan Tran
(74) *Attorney, Agent, or Firm* — Oblon, McClelland, Maier & Neustadt, L.L.P.

(57) ABSTRACT

A fixing device includes a rotatable, endless fixing belt; a rotatable contact member configured to contact a circumferential surface of the fixing belt to form a nip in association with the fixing belt; and a heating member disposed at an interior surface of the fixing belt, configured to heat the fixing belt. The heating member includes a multiple heat sources arranged along the width of a sheet of recording media in a direction perpendicular to a sheet conveyance direction. A controller changes an area to be heated by each heat source based on image data and corresponding to an unfixed image on the sheet. The fixing belt is heated by the heating member so that the unfixed image on the sheet that has been conveyed to the nip is fixed onto the sheet at least with heat. The heating member is disposed at a portion other than the fixing nip.

17 Claims, 14 Drawing Sheets

(56) References Cited

OTHER PUBLICATIONS

U.S. Appl. No. 14/161,078, filed Jan. 22, 2014, Fujimoto, et al.
U.S. Appl. No. 14/167,121, filed Jan. 29, 2014, Samei, et al.
U.S. Appl. No. 14/174,134, filed Feb. 6, 2014, Kishi, et al.
U.S. Appl. No. 14/161,078, filed Jan. 22, 2014.
U.S. Appl. No. 14/167,121, filed Jan. 29, 2014.
U.S. Appl. No. 14/174,134, filed Feb. 26, 2014.

* cited by examiner

FIXING DEVICE AND IMAGE FORMING APPARATUS INCLUDING SAME

CROSS-REFERENCE TO RELATED APPLICATION

The present application claims priority pursuant to 35 U.S.C. §119 from Japanese patent application number 2013-021735, filed on Feb. 6, 2013, the entire disclosure of which is incorporated by reference herein.

BACKGROUND

1. Technical Field

The present invention relates to a fixing device for use in an image forming apparatus such as a printer, a facsimile machine, a copier, and the like, and to an image forming apparatus incorporating such a fixing device.

2. Related Art

Conventionally, an image forming apparatus is configured such that a latent image formed on an image carrier based on image data is developed by toner supplied from a developing device so that a visible toner image is formed on the image carrier. The toner image on the image carrier is transferred onto a recording medium by a transfer device, and is fixed on the recording medium by the fixing device.

JP-H06-138793-A discloses a fixing device in which a rotatably-mounted pressure roller and a flexible endless fixing belt are pressed against each other to form an area of contact herein referred to as a nip or nip portion. The thus-formed fixing device includes a heating member connected to a power source and disposed at an interior side of the fixing belt that forms the nip portion. The heating member contacts the interior surface of the fixing belt and heats the fixing belt electrically, and includes a plurality of heat sources arranged along the width of the sheet perpendicular to a sheet conveyance direction. The heating sources are selectively controlled so that the area heated by each heat source is changed based on the image data and corresponding to an unfixed image on the sheet. As a result, the fixing belt is heated by the heating member so that only that portion of the fixing belt bearing the unfixed toner image is heated. The unfixed image on the sheet that has been conveyed to the nip portion is then fixed onto the sheet with heat and pressure. Compared to a case in which an entire fixing belt is heated up to the fixing temperature, such an arrangement saves energy.

However, heat transfer from a rear side to a surface side of the fixing belt heated by the heating member requires time. Thus, there is a delay between the time the heating member is activated and the time at which the fixing belt attains the desired fixing temperature, thereby possibly causing a fixing error due to insufficient heat. Accordingly, based on the image data of the unfixed image existing in the nip portion after one rotation of the fixing belt, the fixing belt is again heated by the heating member by previously changing the area to be heated by each heat source one rotation of the fixing belt before the unfixed image exists in the nip portion. Accordingly, a predetermined amount of heat can be transferred to the surface of the fixing belt by the time the fixing belt rotates one cycle and the heated portion of the fixing belt again arrives at the nip portion, thereby preventing a fixing error from occurring due to insufficient heat.

However, because the temperature of the fixing belt decreases due to dissipation of the heat from the surface of the fixing belt during rotation of the belt, a large amount of heat needs to be supplied from the heating member to the fixing belt which in turn necessitates heavy energy consumption.

SUMMARY

The present invention provides an optimal fixing device capable of reducing the amount of power required for operation. Such an energy-saving fixing device includes a rotatable, endless fixing belt; a rotatable contact member configured to contact a circumferential surface of the fixing belt to form a nip in association with the fixing belt; and a heating member disposed at an interior surface of the fixing belt and configured to heat the fixing belt. The heating member includes a plurality of heat sources arranged along the width of a sheet of recording media in a direction perpendicular to a sheet conveyance direction. An area to be heated by each heat source is changed based on image data and corresponding to an unfixed image on the sheet. The fixing belt is heated by the heating member so that the unfixed image on the sheet that has been conveyed to the nip is fixed onto the sheet at least with heat. The heating member is disposed at a portion other than the fixing nip.

These and other objects, features, and advantages of the present invention will become apparent upon consideration of the following description of the preferred embodiments of the present invention when taken in conjunction with the accompanying drawings.

DETAILED DESCRIPTION

Hereinafter, preferred embodiments of the present invention will be described with reference to accompanying drawings.

Figure 1:
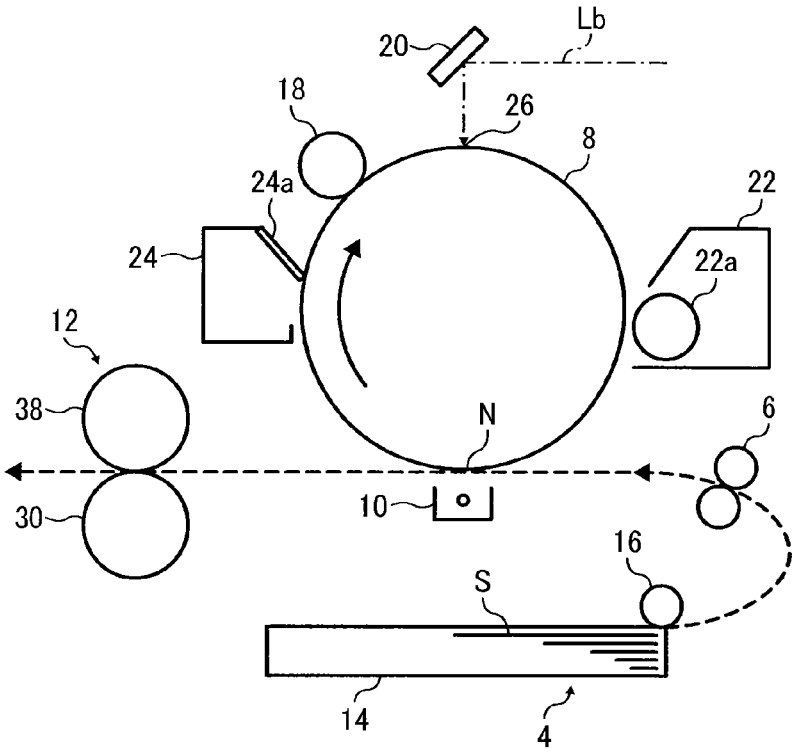
FIG. 1 illustrates a schematic configuration of an image forming apparatus according to a first embodiment of the present invention.

FIG. 1 illustrates a schematic configuration of a printer as an image forming apparatus according to a first embodiment of the present invention.

As illustrated in FIG. 1, the image forming apparatus includes a sheet feeder 4, a registration roller pair 6, a photoreceptor drum 8 as an image carrier, a transfer device 10, and a fixing device 12.

The sheet feeder 4 includes a paper tray 14 and a sheet feed roller 16. The paper tray 14 contains multiple sheets S each as a recording medium stacked thereon. The sheet feed roller 16 separates and sends each sheet one by one from the top of the stacked sheets.

The sheet S sent out by the sheet feed roller 16 is once stopped by the registration roller pair 6, which corrects an alignment error of the sheet S. Then, the sheet S is sent to a transfer portion N by the registration roller pair 6 at a timing synchronizing with a rotation of the photoreceptor drum 8, that is, when a leading end of the toner image formed on the photoreceptor drum 8 is matched with a predetermined position of a leading end of the sheet S in the conveyance direction.

Around the photoreceptor drum 8, a charging roller 18, a mirror 20, a part of exposure means, a developing device 22 including a developing roller 22*a*, a transfer device 10, and a cleaning device 24 including a cleaning blade 24*a* are sequentially disposed along the rotation direction of the photoreceptor drum 8. Exposure light Lb is emitted to an exposure portion 26 on the photoreceptor drum 8 via the mirror 20 at a position between the charging roller 18 and the developing device 22 and scanning is performed.

Image formation in the printer is performed in a manner similar to the conventional technology. Specifically, when the photoreceptor drum 8 starts to rotate, the surface of the photoreceptor drum 8 is charged uniformly by the charging roller 18 and irradiated and scanned by the exposure light Lb based on the image data is, so that a latent image corresponding to the image to be formed is created on the photoreceptor drum 8. The rotation of the photoreceptor drum 8 moves the latent image to a position opposite the developing device 22, where toner is supplied to the latent image from the developing device 22, so that the latent image is rendered visible as a toner image. The toner image formed on the photoreceptor drum 8 is transferred by the transfer device 10 onto the sheet S that has entered into a transfer portion N at a predetermined timing. The sheet S, on which the toner image has been transferred, is conveyed to the fixing device 12 and the toner image on the sheet S is fixed onto the sheet S by the fixing device 12. The sheet S is then discharged onto a paper discharge tray, not shown, and is stacked thereon.

Residual toner remaining on the photoreceptor drum 8 without being transferred from the photoreceptor drum 8 to the sheet S in the transfer portion N is conveyed along with the rotation of the photoreceptor drum 8 to the cleaning device 24, and is scraped off from the photoreceptor drum 8 by the cleaning blade 24*a*, so that the surface of the photoreceptor drum is cleaned. Thereafter, the residual electric charge on the photoreceptor drum 8 is removed by a discharger, not shown, and the photoreceptor drum 8 is prepared for a next image formation process.

Figure 2:
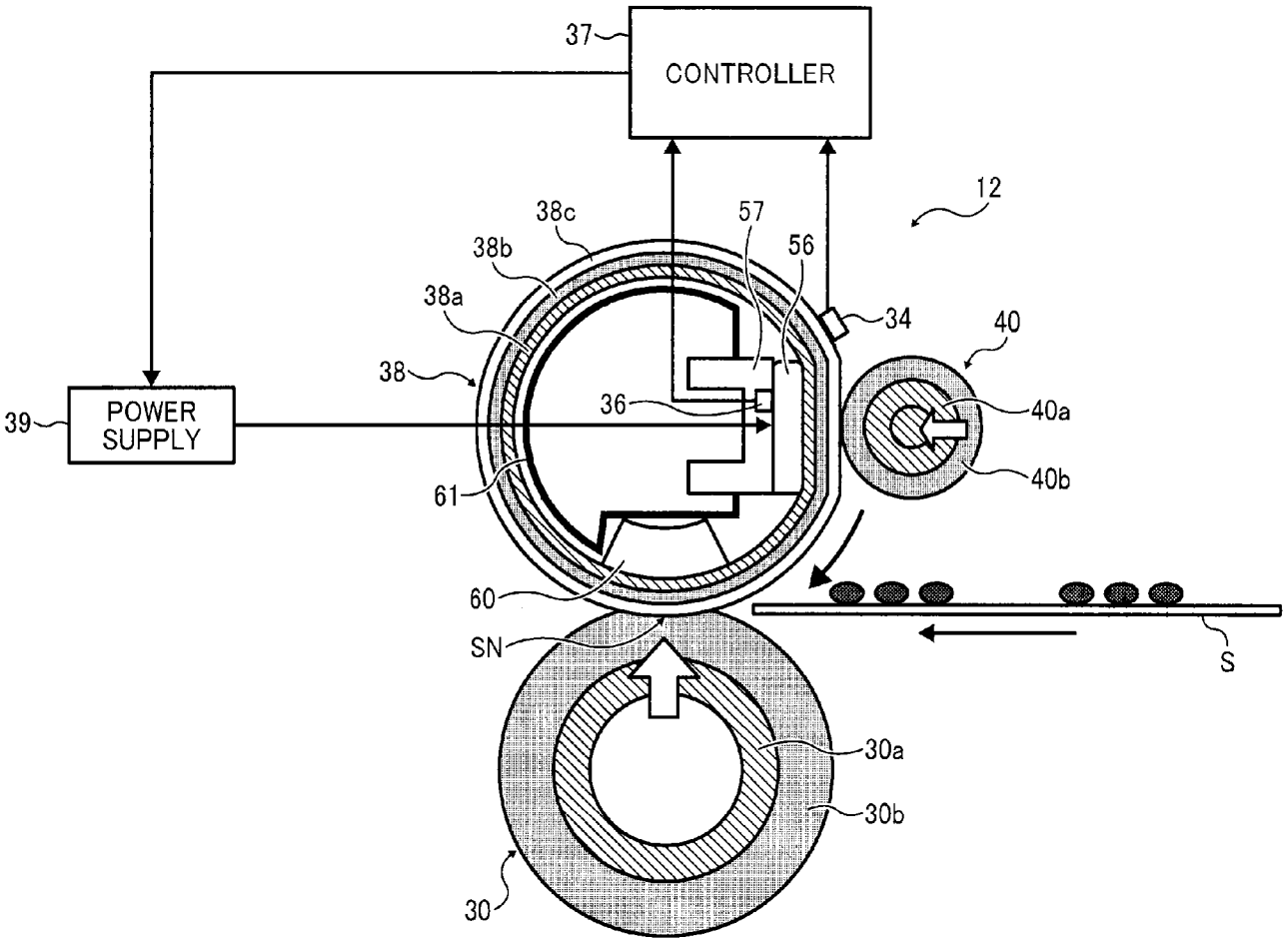
FIG. 2 illustrates a schematic configuration of a fixing device according to the first embodiment of the present invention.
Figure 3A:
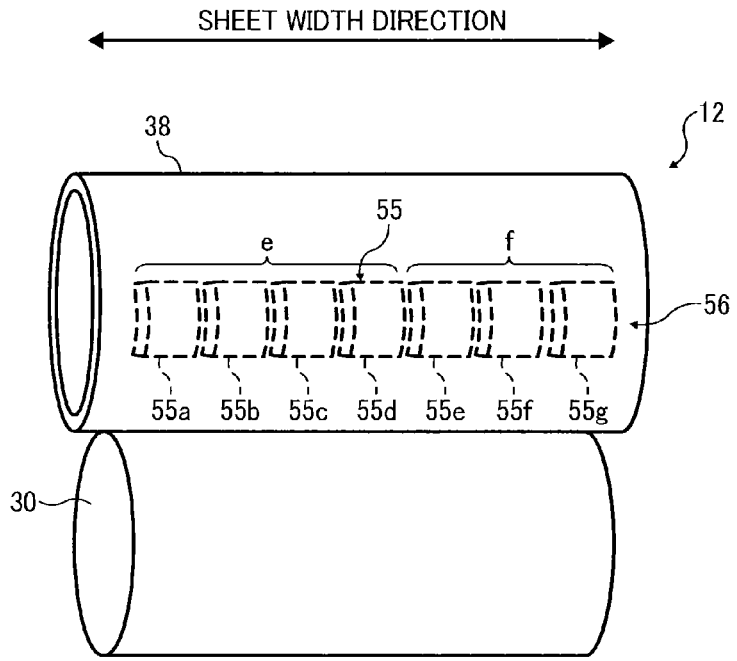
FIG. 3A is an external view of the fixing device and FIG. 3B is a schematic view of a heating member.
Figure 3B:
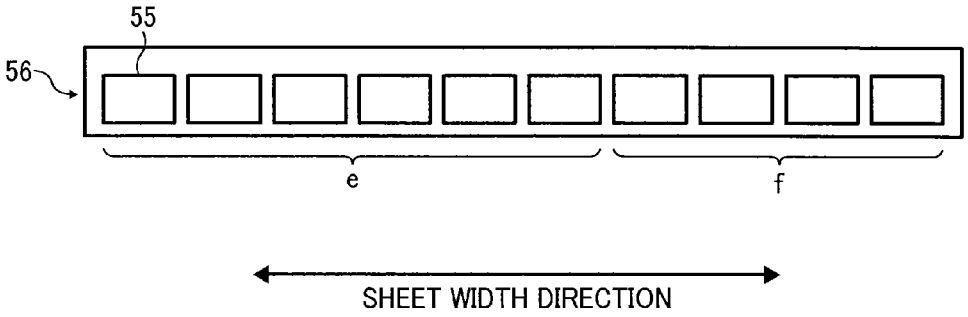

FIG. 2 is a schematic configuration of a fixing device 12 according to a first embodiment of the present invention. FIG. 3A is an external view of the fixing device 12; and FIG. 3B is a schematic view of a heating member 56.

As illustrated in FIG. 2, the fixing device 12 includes a fixing belt 38, a pressure roller 30, and a heating member 56. The heating member 56 is a sheet-shaped heat generator such as a thermal heater. The pressure roller 30 contacts an external surface of the rotatably disposed fixing belt 38 so that a fixing nip portion SN is formed between the fixing belt 38 and the pressure roller 30. In the present embodiment, the pressure roller 30 is pressed against the fixing belt 38 via a biasing member, not shown.

In addition, an elastic roller 40 to which a biasing force is applied from a biasing member, not shown, and which presses against the fixing belt 38, is disposed at a position opposite the heating member 56 via the fixing belt 38 and away from the pressure roller 30. With this configuration, even while the fixing belt 38 is rotating, good contact between the heating member 56, having a substantially flat contact portion with the fixing belt 36, and the fixing belt 38 can be maintained.

The heating member 56 is mounted on a stay-like member 57 and is so disposed as to contact an interior surface of the fixing belt 38. Because the heating member 56 is disposed contacting the interior surface of the fixing belt 38, the heating member 56 does not damage an outer circumferential surface of the fixing belt 38 contacting the toner image on the sheet S, thereby lengthening a lifetime of the fixing belt 38.

The heating member 56 includes a plurality of heaters 55*a*, 55*b*, 55*c*, 55*d*, 55*e*, 55*f*, and 55*g* disposed to cover an entire image forming area over the width of the sheet in a direction perpendicular to the sheet conveyance direction of the sheet S. As illustrated in FIG. 3A, the heating member 56 includes seven heaters arranged along the width of the sheet, each of which can heat the fixing belt 38 independently.

According to the present embodiment, there are seven heaters 55 of the heating member 56. However, the number of heaters is not limited thereto, and may, for example, be fewer or more.

A thermistor 34, a temperature sensor to detect a surface temperature of the fixing belt 38 is disposed downstream in the rotation direction of the fixing belt than the fixing nip portion SN and upstream in the fixing belt rotation direction than the heating member 56. In addition, another thermistor 36 as a temperature sensor to detect a temperature of the heating member 56 is disposed on an opposite side surface at which the heating member 56 contacts the interior surface of the fixing belt 38.

The heating member 56 connects to a power supply 39 which supplies electric power to the heating member 56. When the electric power is supplied to the heater 55 of the heating member 56 from the power supply 39, the heater 55 of the heating member 56 generates heat. In addition, based on the temperature detected by the thermistors 34 and 36, a controller 37 controls the power supply 39 to cause the power supply 39 to supply electricity to the heater 55 of the heating member 56. The controller 37 allows the power supply 39 to independently supply power to each of the divided heaters 55 of the heating member 56. Specifically, the controller 37 is configured as a microcomputer including a CPU, a ROM, a RAM, an I/O interface, and the like.

The fixing belt 38 includes a base member 38*a* formed of a stainless steel having an external diameter of 40 mm and a thickness of 40 μm, and an elastic layer 38*b* coated on a surface of the base member 38*a*. The elastic layer 38*b* is formed of a silicon rubber and has a thickness of 100 μm. Further, a release layer 38*c* formed of fluorine resins such as tetrafluoroethylene-perfluoroalkyl vinylether copolymer (PFA) or polytetrafluoroethylene (PTFE) having a thickness of from 5 μm to 50 μm is formed on an external surface of the elastic layer 38*b* to improve durability and releaseability of the fixing belt 38. The base member 38*a* of the fixing belt 38 may employ polyimide as a material. When polyimide is employed for the base member 38*a*, thermal capacity of the fixing belt 38 can be reduced and a highly responsive base member 38*a* is formed even with the same thickness compared to the case in which the metal material is used. Because of flexibility greater than that of the metal belt, a pressing load is reduced and thus the torque can be reduced.

Other than the heating member 56, the fixing device 12 further includes, in an interior of the fixing belt 38, a belt support member 61 and a nip forming member 60. The belt support member 61 supports the fixing belt 38 and the nip forming member 60 forms the fixing nip portion SN in association with the pressure roller 30 with the fixing belt 38 in between. These members are connected to a side plate of the apparatus, not shown, and are supported thereby.

The belt support member 61 is inserted at both lateral ends of the fixing belt 38 in the axial direction perpendicular to the rotation direction of the fixing belt 38. Each end of the fixing belt 38 is rotatably supported by the belt support member 61.

The pressure roller 30 includes a metal core 30*a* formed of iron having an external diameter of 40 mm and a thickness of 2 mm, and an elastic layer 30*b* coated on a surface of the metal core 30*a*. The elastic layer 30*b* is formed of a silicon rubber and has a thickness of 5 mm. Further, it is preferred that a fluorine resin layer having a thickness of approximately 40 μm be provided on a surface of the elastic layer 30*b* to increase releaseability.

In addition, in the present embodiment, a contact surface between the heating member 56 and the fixing belt 38 is configured to be substantially flat. Conceivably, the heating member 56 could be formed in a semicircular column shape to conform to the shape of an interior surface of the fixing belt 38 so that the heating member 56 can be optimally contacted against the interior surface of the fixing belt 38; however, assembling/mounting heater members and circuitry to a curved surface requires complicated processes and the semicircular column shape is not adequate for the higher precision and production performance required compared to assembling heaters and circuitry on a flat surface. As a result, in the present embodiment, a flat-type heat generator that excels in the precision and productivity is used as the heating member 56, so that heat generation efficiency is improved due to the high precision mounting.

On the other hand, when the fixing belt 38 is employed as a fixing member for the purposes of low thermal capacity and compact size, securing a flat portion of the fixing belt 38 is difficult to achieve simply by disposing the flat-shaped heating member 56 alone. Accordingly, the interior surface of the rotating fixing belt 38 and the heating member 56 need to be contacted sufficiently.

If the heating member 56 is disposed at a portion of the fixing belt forming the fixing nip portion SN along with the pressure roller 30, even when the fixing belt 38 is rotating, contact between the fixing belt 38 and the heating member 56 can be maintained. However, heat transfer from a rear side to a surface side of the fixing belt 38 heated by the heating member 56 requires time. Accordingly, even though the fixing belt 38 is heated by the heating member 56 at the portion of the fixing belt forming the fixing nip portion SN, the heat is not transferred to the toner on the sheet S at the fixing nip portion SN immediately after the heating.

The heat of the fixing belt 38 heated by the heating member 56 is transferred to the surface of the fixing belt while the fixing belt 38 is rotating. However, until the fixing belt 38 rotates one cycle and the heated portion of the fixing belt 38 again arrives at the fixing nip portion SN, the heat transferred to the surface of the fixing belt continues to dissipate from the surface thereof. Considering the fact that the temperature of the fixing belt 38 decreases due to the dissipation of the heat, a large amount of heat needs to be supplied from the heating member 56 to the fixing belt 38, which results in heavy energy consumption.

In the fixing device 12 according to the present embodiment as illustrated in FIG. 2, the heating member 56 is disposed at a portion other than the fixing nip portion SN of the fixing belt 38. As a result, compared to a case in which the heating member 56 is disposed at the fixing nip portion SN, the discharged heat amount from the surface of the fixing belt from when the portion of the fixing belt 38 heated by the heating member 56 rotates one cycle and until the heated portion of the fixing belt 38 again arrives at the fixing nip portion SN, can be reduced. As a result, the heat amount to be supplied to the fixing member 38 from the heating member 56 so that the fixing temperature at the fixing nip portion SN can be secured can be reduced, thereby reducing the amount of electricity to be supplied to the heating member 56 from the power supply 39 and saving energy.

The elastic roller 40 has an external diameter ϕ of from 15 to 30 mm and is comprised of a metal core 40*a* formed of iron having an external diameter ϕ of 8 mm and an elastic layer 40*b* coated on a surface of the metal core 40*a*. The elastic layer 40*b* is formed of a silicon rubber having a thickness ranging from 3.5 to 11 mm. It is preferred that a fluorine resin layer having a thickness of approximately 40 μm be provided on a surface of the elastic layer 40*b* to increase releaseability.

In the fixing device 12 according to the present embodiment, the controller 37 controls a supply of electricity from the power supply 39 to each heater 55 of the heating member 56 based on the image data to form an image on the sheet S to achieve energy saving. Hereinafter, an example of controlling operation will be described.

Figure 4A:
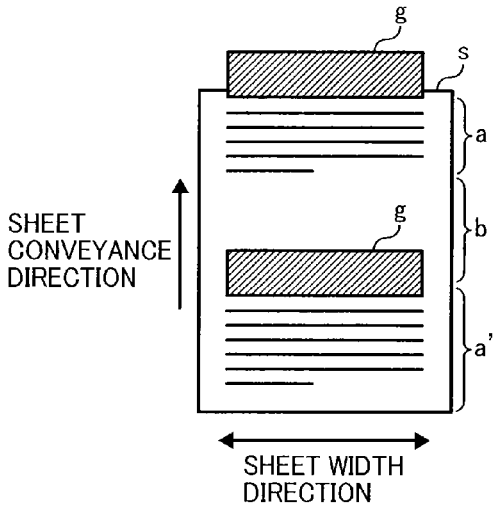
FIGS. 4A and 4B are plan views each illustrating an image pattern.

FIG. 4A shows image formation patterns on the sheet S sequentially from a leading end of the sheet in the sheet conveyance direction, including an image area a, a blank area b, and an image area a'. Fixing of images onto the sheet is required in the image areas a and a'; however, because there is no image in the blank area b and the toner as a target for fixation does not exist, fixing operation is not required.

Image data of the above image formation patterns is input into the controller 37 from an image processor, not shown. Then, the controller 37 controls the heating member 56 such that the temperature of the portion corresponding to the blank area b of the fixing belt 38 becomes lower than that of the portions corresponding to the image area a and the image area a' of the fixing belt 38. Specifically, the controller 37 controls the power supply 39 such that the heating member 56 is given enough power to obtain the fixing temperature at the portions corresponding to the image area a and the image area a' and is given less power that does not obtain than the fixing temperature at the blank area b. "Portions corresponding to the image area or the blank area" means the positions at which the fixing belt 38 contacts.

Figure 4B:
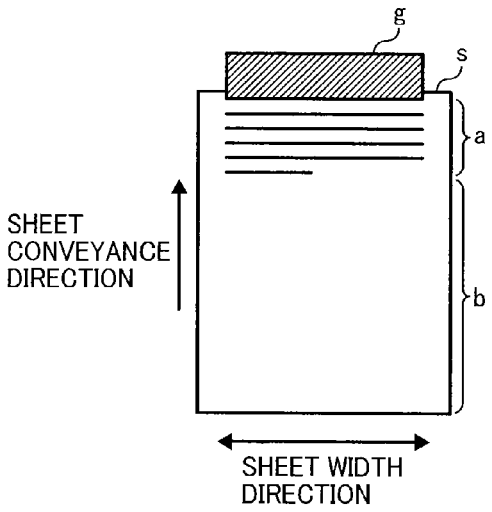

FIG. 4B shows image formation patterns on the sheet S sequentially from a leading end of the sheet in the sheet conveyance direction, including an image area a and a blank area b. Similarly to the case illustrated in FIG. 4A, the controller 37 controls the heating member 56 such that the temperature of the portion corresponding to the blank area b of the fixing belt 38 becomes lower than that of the portions corresponding to the image area a of the fixing belt 38. Specifically, the controller 37 controls the power supply 39 such that the heating member 56 is given enough power to obtain the fixing temperature at the portions corresponding to the image area a and is given less power at the blank area b.

Figure 5:
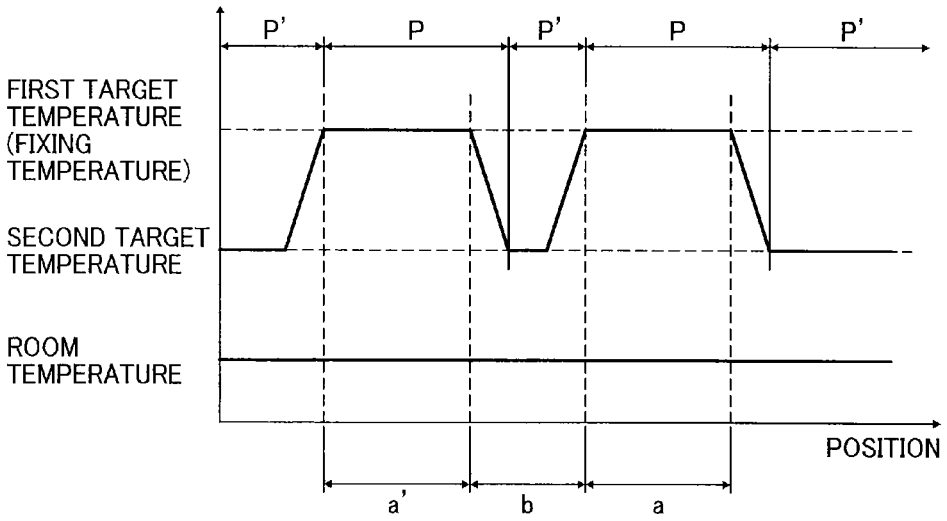
FIG. 5 is a graph depicting a relation between image and blank areas and first and second target temperatures.

Conceivably, the controller 38 could control the power supply to the heating member 56 to shut off completely at the portion corresponding to the blank area b of the fixing belt 38. However, lowering the temperature of the fixing belt 38 excessively simply delays a rise of the temperature up to the fixing temperature for a next image area. Accordingly, as illustrated in FIG. 5, it is preferred that the temperature of the fixing belt 38 be kept at a second temperature which is lower than the fixing temperature and higher than room temperature.

With such a configuration, the heating member 56 is supplied with electricity and heated at the portion corresponding to the blank area b of the fixing belt 38, but the power consumption is reduced compared to a case in which the temperature of the portion corresponding to the blank area b of the fixing belt 38 is set to the fixing temperature. Specifically, because the supplied electricity in areas P' is lower than that in areas P, energy saving is achieved.

Figure 6A:
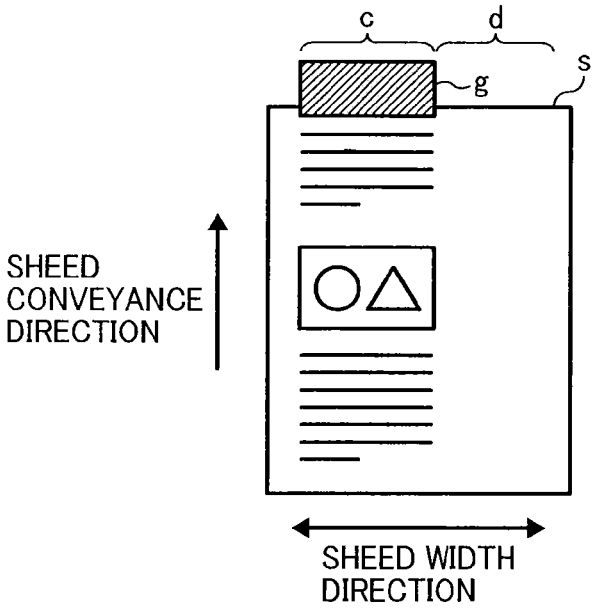
FIGS. 6A and 6B are plan views each illustrating an image pattern.
Figure 6B:
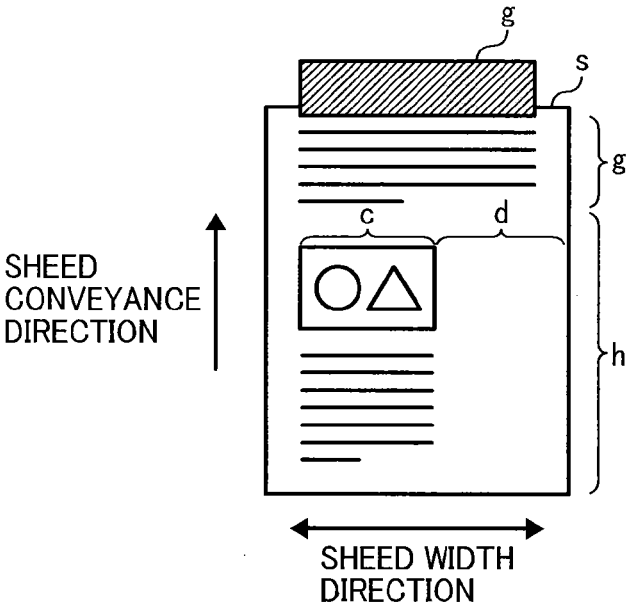

FIG. 6A shows an image formation pattern on the sheet S mixing an image area 'c' and a blank area FIG. 6B shows an image formation pattern on the sheet S, in which sequentially from a leading end of the sheet in the sheet conveyance direction, the image area a, and a mixed area 'h' including an image area 'c' and a blank area 'd' in the width of the sheet exist.

Similarly to the case described above, the controller 37 controls the heating member 56 such that the temperature of the portion corresponding to the blank area 'd' of the fixing belt 38 becomes lower than that of the portions corresponding to the image area a and the image area of the fixing belt 38. Specifically, the controller 37 controls the power supply 39 such that the heating member 56 is given enough power to obtain the fixing temperature at the portions corresponding to the image area a and the image area 'c' and is given less power at the blank area 'd'.

Specifically, when the heating member 56 heats the portion corresponding to the image area a of the fixing belt 38, all heaters 55*a*, 55*b*, 55*c*, 55*d*, 55*e*, 55*f*, and 55*g* included in the heating member 56 are supplied electricity (see FIG. 3A). On the other hand, when the heating member 56 heats the portion corresponding to the blank area c of the fixing belt 38, all heaters 55*a*, 55*b*, 55*c*, and 55*d* included in a heating area e are supplied electricity (see FIG. 3A). Specifically, the heaters 55*e*, 55*f*, and 55*g* included in a heating area f are not supplied with electricity.

In addition, in the present embodiment, when electricity is supplied to the heating member 56 from the power supply 39 such that a preliminary heating area g, which is a portion in the sheet conveyance direction before the image area enters into the fixing nip portion SN, is preliminarily heated, as illustrated by shaded areas in FIGS. 4 and 6. The preliminary heating area g is an area that becomes necessary due to a length required for heat generation in the circumferential direction of the heating member 56 or because the heating member 56 itself needs a time for temperature rise. The preliminary heating area g is preferably as small as possible from the viewpoint of energy saving.

Figure 7:
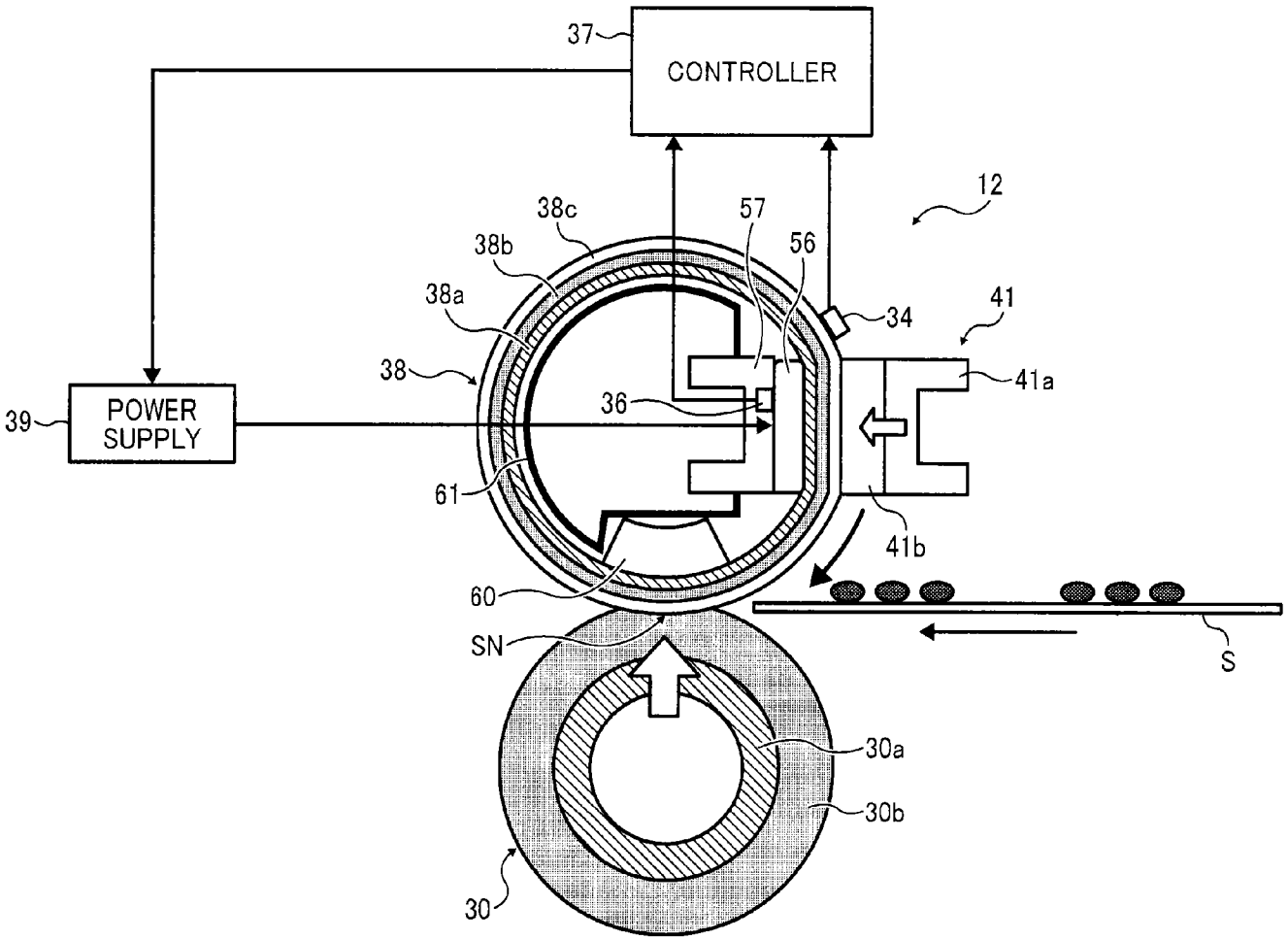
FIG. 7 is a schematic configuration of a fixing device according to a second embodiment.

FIG. 7 illustrates a second embodiment of the present invention. As illustrated in FIG. 7, the fixing device 12 includes a pressure pad 41 formed of an elastic material and disposed opposite the heating member 56 via the fixing belt 38.

The pressure pad 41 is supported by a stay 41*a*, to which a load is given from a biasing member, not shown, and the pressure pad 41 is pressed against the fixing belt 38 and the heating member 56. With this configuration, even while the fixing belt 38 is rotating, good contact between the fixing belt 38 and the heating member 56 can be maintained. In addition, by using a pad member as a pressurizing member, a contact area becomes wider than the case of using the elastic roller 40 as described in the first embodiment and the contact between the heating member 56 and the fixing belt 38 can be stably secured.

On the surface of the pressure pad 41, a felt or sheet material formed of silicon rubber, or heat-resistance fiber such as aramid fiber is employed. If the fiber material is used for the surface of the pressure pad 41, because the fiber material soaks up silicon oils, it reduces friction resistance relative to the surface of the fixing belt 38 and improves releaseability.

On the other hand, a fluorine resin layer having a thickness of from 50 to 100 μm can be formed on the surface of the pressure pad 41, thereby reducing friction resistance relative to the surface of the fixing belt 38 and improving releaseability.

Figure 8:
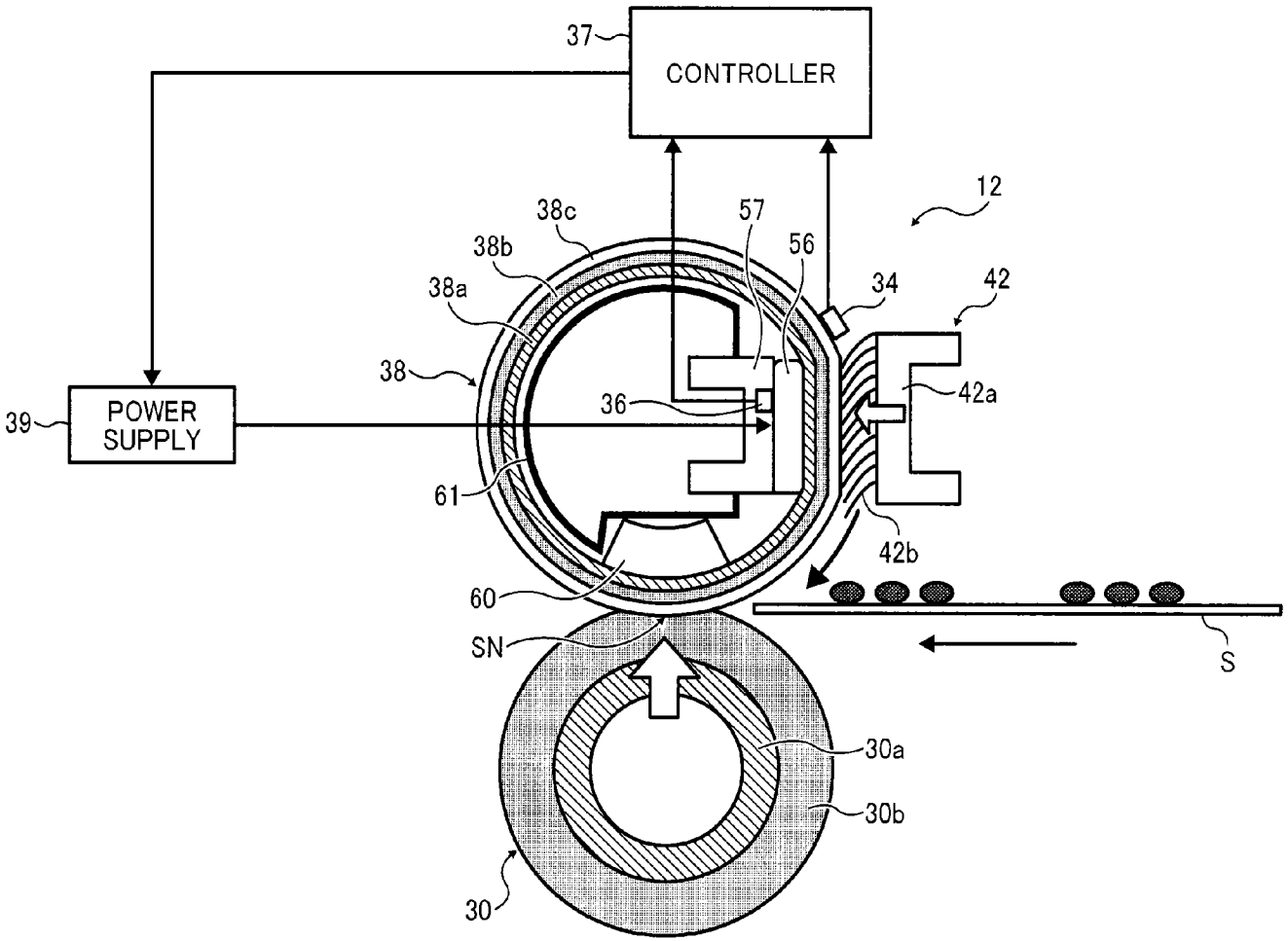
FIG. 8 is a schematic configuration of a fixing device according to a third embodiment.

FIG. 8 illustrates a third embodiment of the present invention. As illustrated in FIG. 8, the fixing device 12 includes a pressure brush 42 disposed opposite the heating member 56 via the fixing belt 38.

The pressure brush 42 is supported by a stay 42*a*, to which a load is given from a biasing member, not shown, and the pressure brush 42 is pressed against the fixing belt 38 and the heating member 56. With this configuration, even while the fixing belt 38 is rotating, good contact between the fixing belt 38 and the heating member 56 can be maintained. In addition, using a brush member as a pressurizing member allows a contact area to be wider than using the elastic roller 40 and the contact between the heating member 56 and the fixing belt 38 can be stably maintained.

A pile member in which fibers having heat-resistant property such as polyimide are mixed in a base formed of aramid fibers, may preferably be used for the pressure brush 42. In addition, an entire pile length is from 1 to 8 mm and the pressure is applied such that the pile bites the surface of the fixing belt 38 in the depth of 1 to 2 mm.

In addition, when the pressure member is the pressure brush 42, a contact resistance between the fixing belt 38 and the pressure brush 42 is small and the torque load of the fixing belt 38 can be reduced.

Figure 9:
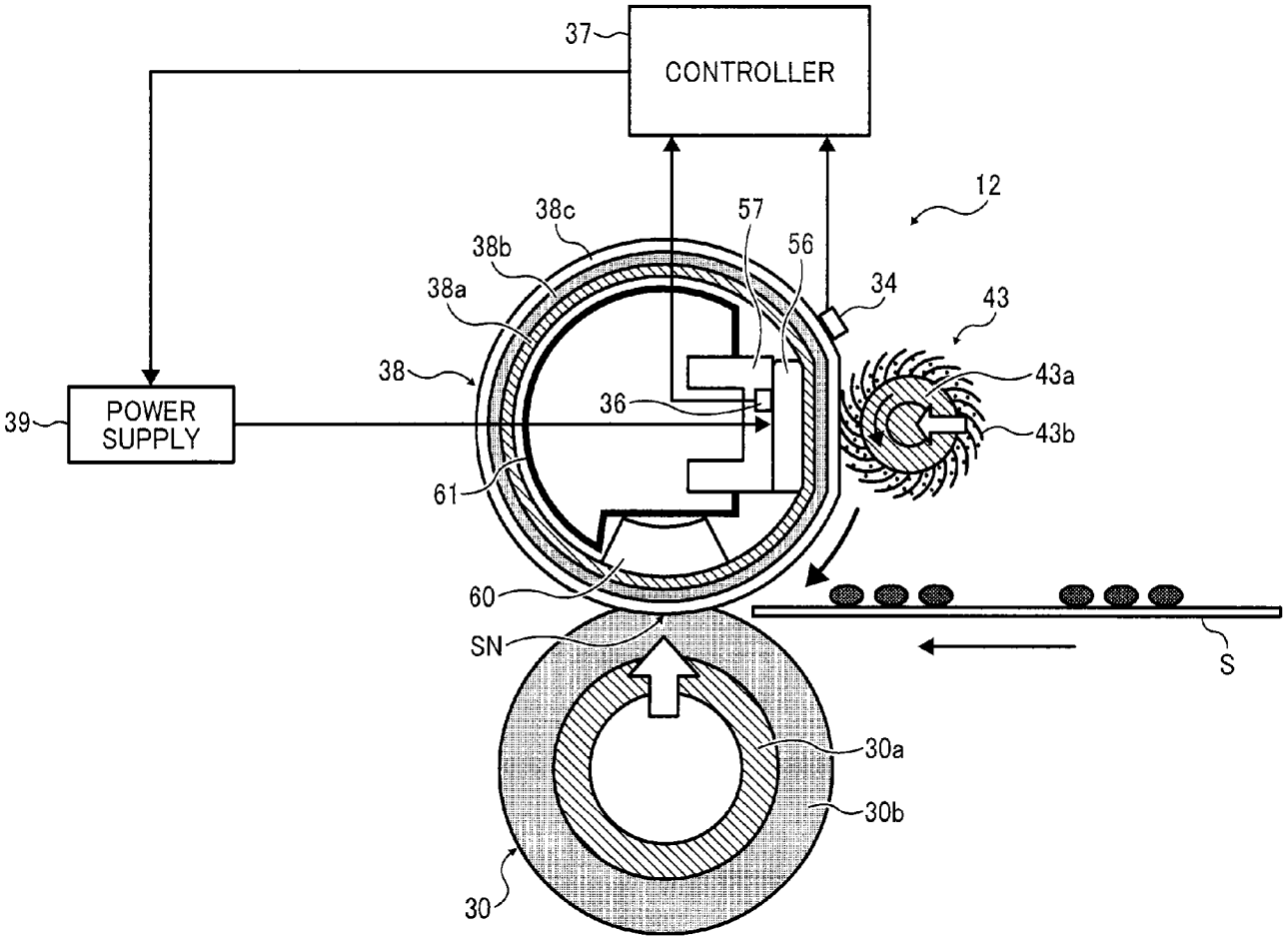
FIG. 9 is a schematic configuration of a fixing device according to a fourth embodiment.

FIG. 9 illustrates a fourth embodiment of the present invention. As illustrated in FIG. 9, the fixing device 12 includes a pressure brush roller 43 disposed opposite the heating member 56 via the fixing belt 38 and rotatable about a rotary axis thereof.

The pressure brush roller 43 having an external diameter ϕ of from 15 to 30 mm includes a metal core 43*a* made of iron having an external diameter ϕ of 8 mm and a brush portion 43*b* formed of fibers with heat resistant property such as polyimide. A pile member in which heat resistant fibers are mixed in a base formed of aramid fibers may preferably be used for the brush portion 43*b*. In addition, an entire pile length is from 1 to 8 mm and the pressure is applied such that the pile bites the surface of the fixing belt 38 in the depth of 1 to 2 mm.

Because the pressure brush roller 43 is pressed against the fixing belt 38, the pressure brush roller 43 can be driven by the rotation of the fixing belt 38 without disposing a driving means to rotatably drive the pressure brush roller 43, or may be configured to be driven by any driving means. A structure in which the pressure brush roller 43 is driven by a rotation of the fixing belt 38 without the driving means is more cost effective and can save space. However, driving the pressure brush roller 43 to rotate by the driving means can provide more stable contact between the pressure brush roller 43 and the fixing belt 38 than when being driven solely by the rotation of the fixing belt 38.

When a surface speed of the pressure brush roller 43 is equal to the surface speed of the fixing belt 38, friction between the two is reduced and a longer lifetime is possible. Conversely, when the surface speeds of the both are different, including both cases in which the surface speed of the pressure brush roller 43 relative to that of the fixing belt 38 is positive or negative, the greater difference the more stable the contact becomes. In addition, a cleaning effect of the surface of the fixing belt due to the pressure brush roller 43 is improved.

In the present embodiment, the pressure brush roller 43 and the fixing belt 38 rotate in a same direction in the portion where the pressure brush roller 43 and the fixing belt 38 are disposed oppositely; however, the rotation direction of the pressure brush roller 43 can be set opposite that of the fixing belt 38.

In addition, although not illustrated in the present fourth embodiment, the pressure brush roller 43 may be provided with a cleaning device and can be cleaned by the cleaning device.

Figure 10:
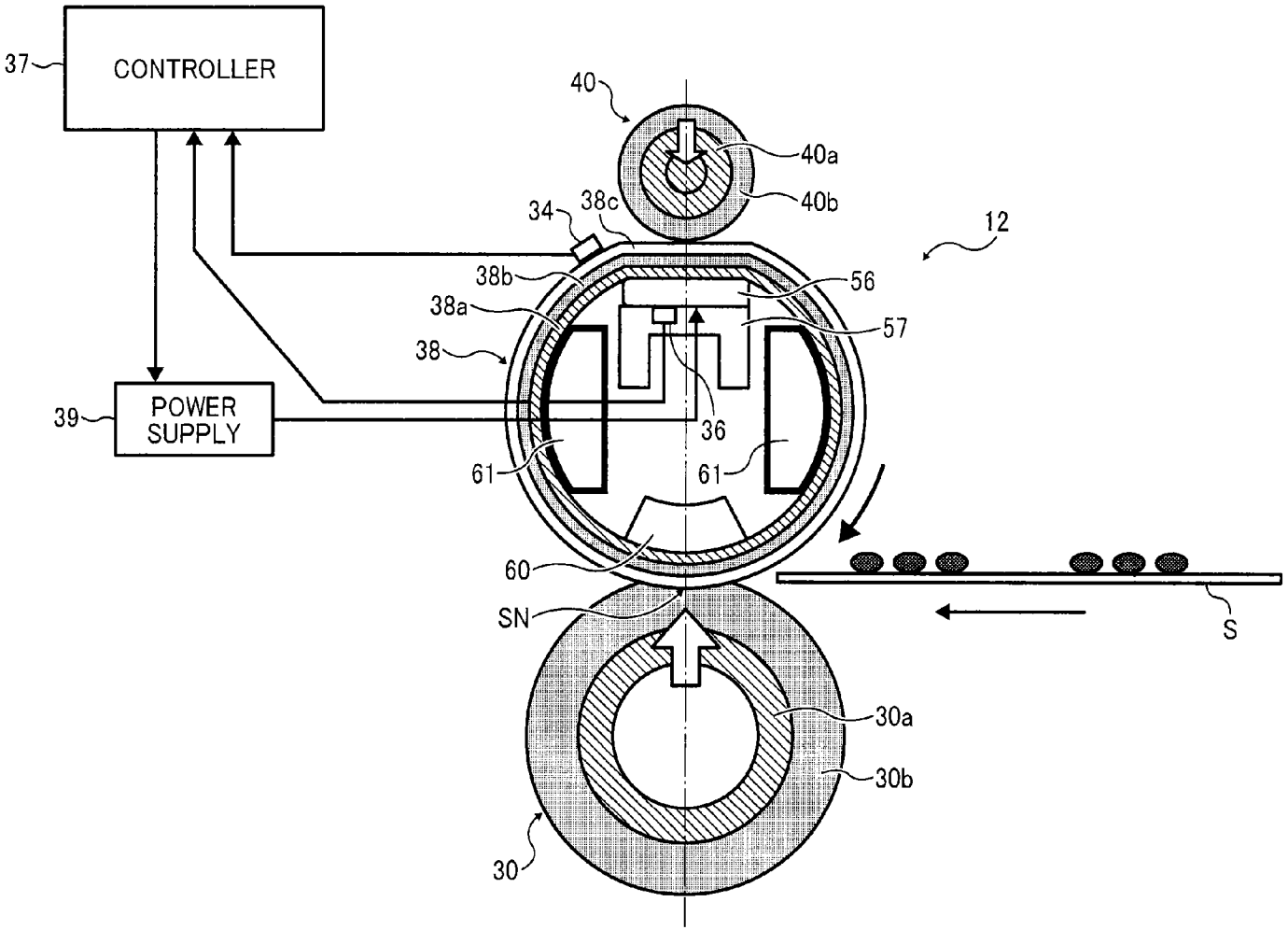
FIG. 10 is a schematic configuration of a fixing device according to a fifth embodiment.

FIG. 10 illustrates a fifth embodiment of the present invention. As illustrated in FIG. 10, the fixing device 12 includes the nip forming member 60 disposed on an interior surface of the fixing belt 38 opposite the fixing nip portion SN so as to form the fixing nip portion SN. Then, the heating member 56 and the elastic roller 40 opposite the heating member 56 are disposed on an extended line connecting substantially the center of the fixing nip portion SN and substantially the center line of the pressure roller 30.

In addition, the elastic roller 40 which is applied a biasing force from a biasing member, not shown, and presses against the fixing belt 38 is disposed at a position opposite the heating member 56 via the fixing belt 38. With this configuration, even while the fixing belt 38 is rotating, good contact between the fixing belt 38 and the heating member 56 can be maintained.

Herein, the pressure member to press against the fixing belt 38 at a position opposite the heating member 56 via the fixing belt 38 is not limited to the elastic roller 40. For example, the pressure pad 41 or the pressure brush 42, and the pressure brush roller 43 may be used as the pressure member as long as the structure can maintain good contact between the fixing belt 38 and the heating member 56.

In an interior of the fixing belt 38, the belt support member 61 and the nip forming member 60 both supporting the fixing belt 38 are disposed. They are connected to and supported by a side plate of the apparatus, not shown.

In the present embodiment as illustrated in FIG. 10, a load of the elastic roller 40 pressing against the heating member 56 is applied downwardly and a load of the pressure roller 30 pressing against the nip forming member 60 is applied upwardly. As a result, both loads are canceled and the load of the side plate of the apparatus supporting the belt support member 61 and the nip forming member 60 is reduced. Thus, the side plate is not bent so much, thereby suppressing biasing of the belt due to the bending of the side plate. Further, the side plate may be simply constructed.

Figure 11:
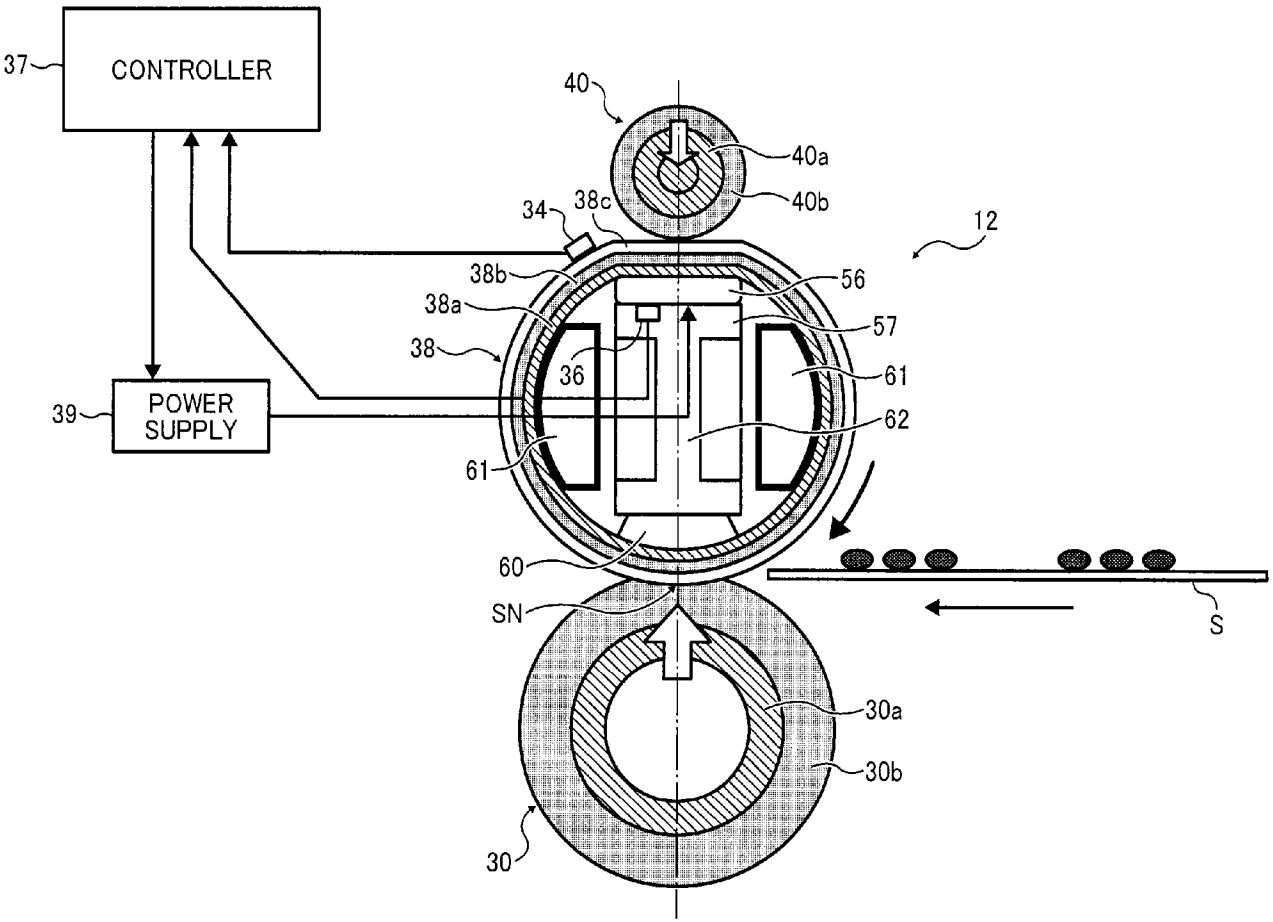
FIG. 11 is a schematic configuration of a fixing device according to a sixth embodiment.

FIG. 11 illustrates a sixth embodiment of the present invention. As illustrated in FIG. 11, the nip forming member 60 to form the fixing nip portion SN is disposed on an interior surface of the fixing belt 38 corresponding to the fixing nip portion SN. Then, the heating member 56 and the elastic roller 40 opposite the heating member 56 are disposed on an extended line connecting substantially the center of the fixing nip portion SN and substantially the center line of the pressure roller 30.

The pressure member to press against the fixing belt 38 at a position opposite the heating member 56 via the fixing belt 38 is not limited to the elastic roller 40. For example, the pressure pad 41 or the pressure brush 42, and the pressure brush roller 43 may be used as the pressure member as long as the structure can maintain good contact between the fixing belt 38 and the heating member 56.

On an interior side of the fixing belt 38, the belt support member 61 and the nip forming member 60 both supporting the fixing belt 38 are disposed. They are connected to and supported by the side plate of the apparatus, not shown.

The load of the elastic roller 40 pressing against the heating member 56 and the load of the pressure roller 30 pressing against the nip forming member 60 are applied to the side plate of the apparatus supporting the belt support member 61 and the nip forming member 60. The load is finally applied to a stay 62 supporting the heating member 56 or the nip forming member 60.

If the stay 62 is not constructed rigidly enough to support the load and is easily bent by each load of the elastic roller 40 and the pressure roller 30, good contact between the fixing belt 38 and the heating member 56 or an even nip width at the fixing nip portion SN cannot be obtained. As a result, enough rigidity is required for the stay 62 so as not to be bent due to each load.

However, even though a rigidity of the stay 62 is secured by enlarging the size of the stay 62 or by using multiple stays, the entire size of the apparatus may also be enlarged as well. As a result, because it is necessary to both downsize the fixing belt 38 and strengthen the stay 62, the nip forming member 60 and the heating member 56 are supported by the stay 62 with enough rigidity. Accordingly, the nip forming member 60, the heating member 56, and the stay 62 can be disposed on the interior surface of the fixing belt 38 with a smaller diameter.

In general, the load applied to the nip forming member 60 is greater than that applied to the heating member 56 because the upward load applied to the nip forming member 60 is greater, and therefore, the rigidity of the stay 62 should be strong enough to endure the load applied to the nip forming member 60 and not to cause bending of the stay 62 itself.

Next, seventh to tenth embodiments according to the present invention will be described. A redundant description concerning the same structure as in the first to sixth embodiments will be omitted.

Figure 12:
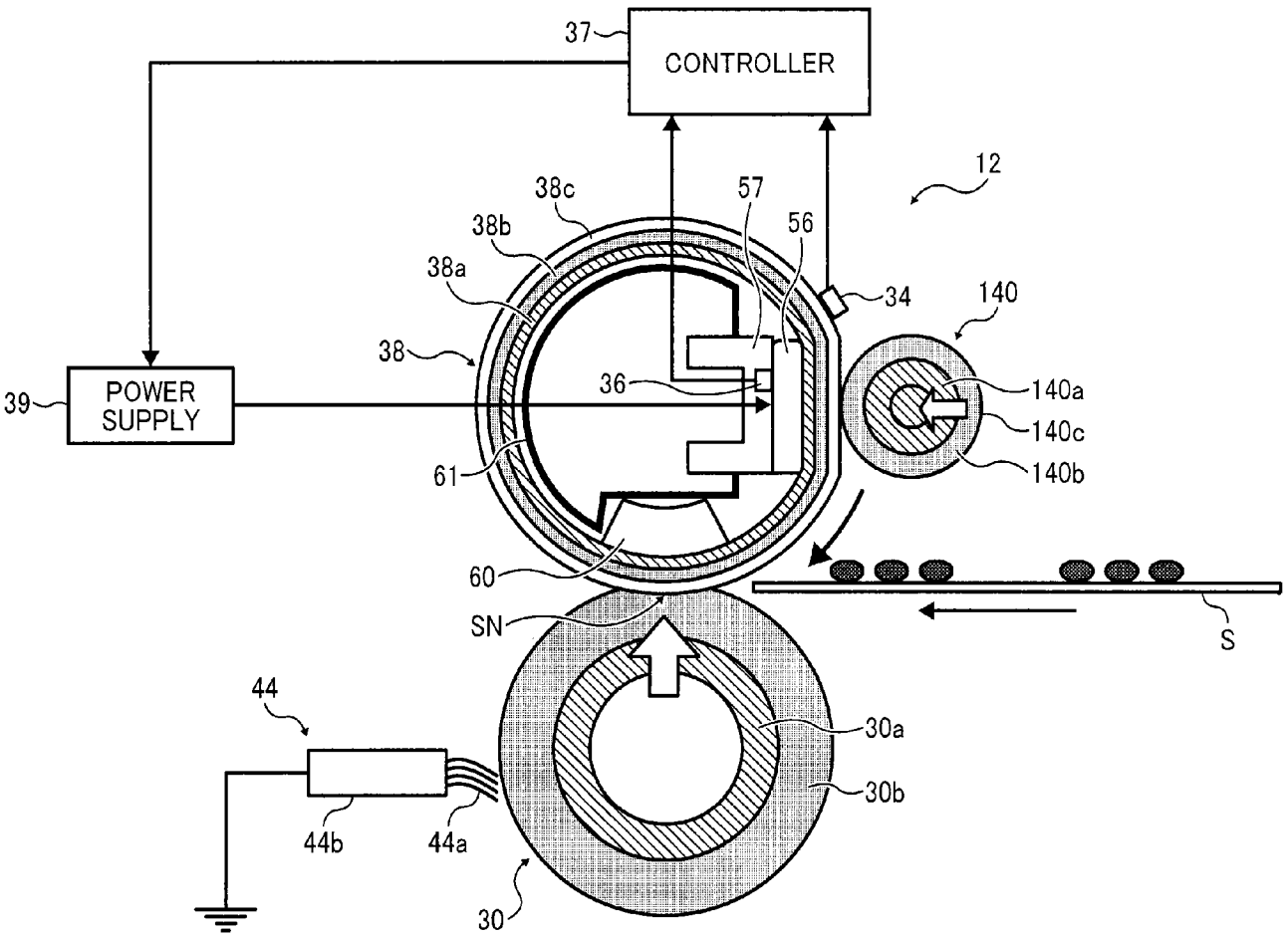
FIG. 12 is a schematic configuration of a fixing device according to a seventh embodiment.

The seventh embodiment referring to FIG. 12 will be described. As illustrated in FIG. 12, the fixing device 12 includes an elastic roller 140 configured to press against the fixing belt 38 by being applied with a biasing force by a biasing member, not shown. The elastic roller 140 is disposed opposite the heating member 56 via the fixing belt 38, so as to press-contact the fixing belt 38. With this configuration, even while the fixing belt 38 is rotating, good contact between the fixing belt 38 and the heating member 56 can be maintained.

The elastic roller 140 functions also as an oil applicator to coat the oil on the surface of the fixing belt 38 so that adhesion of the toner from the sheet S to the fixing belt 38 is prevented. In addition, the elastic roller 140 includes a metal core 140*a*, sponge-like foam 140*b*, and a semi-transparent film 140*c*. The foam 140*b* is disposed on a circumference of the metal core 140*a* and includes silicon oils in the sponge-like body. The semi-transparent film 140 including minute holes is wound around the circumference of the foam 140*b* once or twice. The silicon oil included in the foam 140*b* is leaked through the semi-transparent film 140, so that a slight amount of oil is coated on a surface of the fixing belt 38.

If occasionally a sheet jamming occurs in the conveyance path of the sheet S inside the image forming apparatus, the toner adhered from the sheet S to the fixing belt 38 may be adhered from the fixing belt 38 to the surface of the elastic roller 140. To prevent this, the semi-transparent film 140 to form the surface layer of the elastic roller 140 employs materials with good releaseability capable of preventing the toner adhered on the surface of the elastic roller 140 from setting. This is because if the toner is set on the surface of the elastic roller 140, the minute holes on the semi-transparent film 140 through which oils can be leaked are clogged by the toner, so that coating the oil on the elastic roller 140 becomes impossible. Preferable materials for the semi-transparent film 140 include Gore-Tex (a registered trademark of W. L. Gore and Associates) films because of its releasable property.

In the present seventh embodiment, a conductive layer is coated on the elastic layer 30*b* of the pressure roller 30. A discharging brush 44 is disposed near the pressure roller 30 so as to discharge an electrical charge from the pressure roller 30. As a result, the charged charge of the pressure roller 30 is reduced and electrical charge difference between the pressure roller 30 and the fixing belt 38 is reduced, so that an electrostatic offset in which the toner is adhered from the sheet S to the fixing belt 38 by an electrostatic force, can be reduced.

Preferred materials for the conductive layer coated on the elastic layer 30*b* of the pressure roller 30 include for example PFA mixed with carbon. When the conductive layer is formed on the elastic layer 30*b* of the pressure roller 30, a circumferential surface of the pressure roller 30 becomes conductive. If the surface resistivity of the pressure roller 30 is in a range from $1*10^8\Omega/m^2$ to $1*10^6\Omega/m^2$, it is conceived that the pressure roller 30 has conductivity.

The discharging brush 44 includes an electrode 44*a* and a holder 44*b*. The electrode 44*a* is fixed to the holder 44*b* formed of a conductive material. Preferred materials for the electrode 44*a* include, for example, (1) multiple fiber-like stainless steel bound together; (2) acrylic fiber dispersed with carbon particles in a streak or dyed with copper ions; (3) carbon fiber alone; and (4) conductive unwoven cloth.

The discharging brush 44 is disposed on the left in FIG. 12 so that the electrode 44*a* can good contact or be away at a certain distance relative to the circumferential surface of the pressure roller 30. The discharging brush 44 can be disposed in the bottom of the pressure roller 30.

As described above, when the pressure roller 30 is electrically discharged by the discharging brush 44, the electrical charge difference between the pressure roller 30 and the fixing belt 38 is reduced and the amount of toner electrostatically attracted from the sheet S to the fixing belt 38 is reduced, so that the electrostatic offset is reduced. Accordingly, the amount of offset toner to be adhered from the fixing belt 38 to the elastic roller 140 can be reduced. As a result, durability of the elastic roller 140 is improved, and because the offset toner is not developed to agglomerated particles, a quality image is formed on the sheet S.

Figure 13:
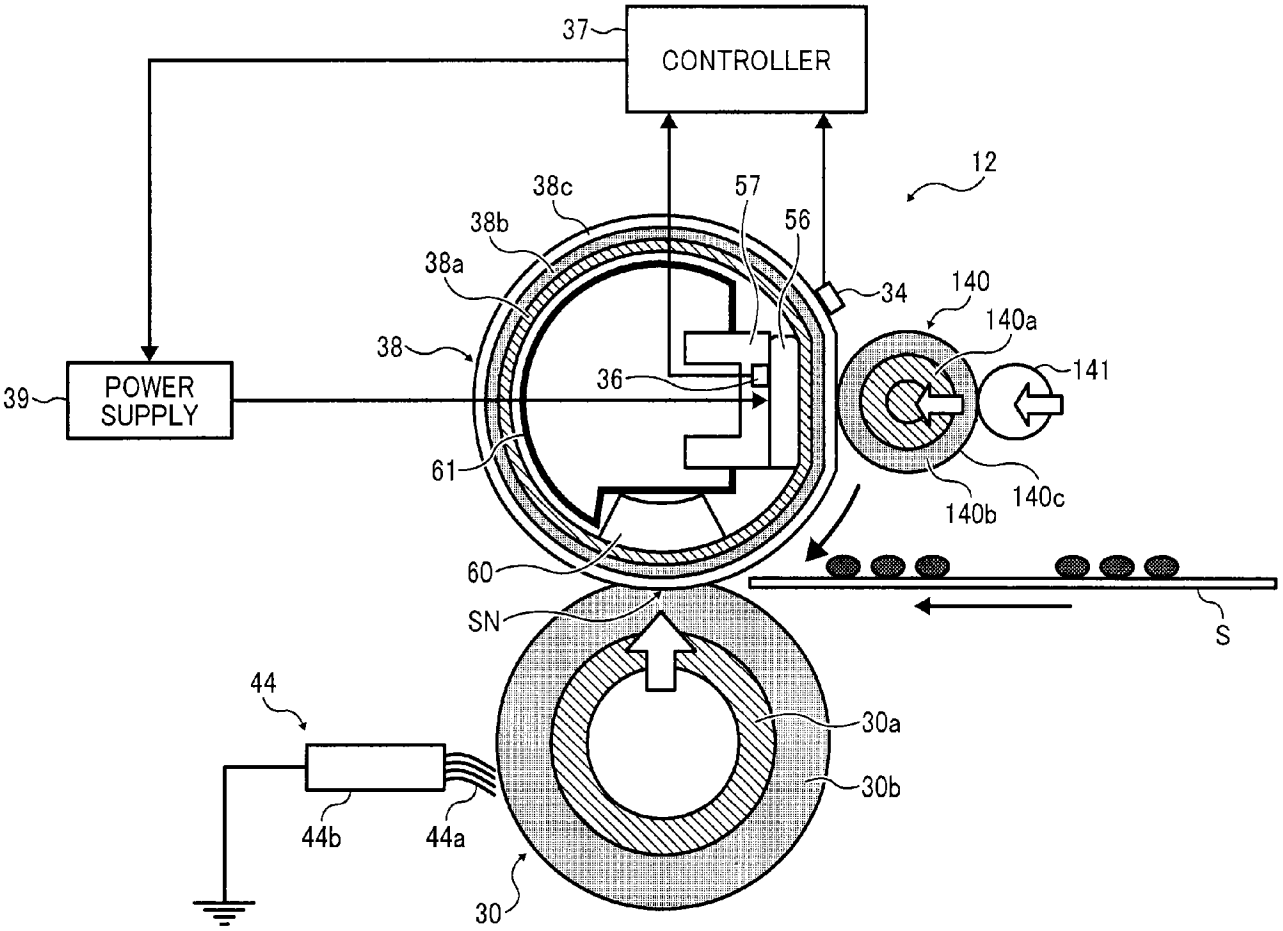
FIG. 13 is a schematic configuration of a fixing device according to an eighth embodiment.

An eighth embodiment will be described referring to FIG. 13. As illustrated in FIG. 13, the fixing device 12 includes the elastic roller 140 configured to press against the fixing belt 38 by being applied with a biasing force by a biasing member, not shown. The elastic roller 140 is disposed opposite the heating member 56 via the fixing belt 38, so as to press-contact the fixing belt 38. With this configuration, even while the fixing belt 38 is rotating, good contact between the fixing belt 38 and the heating member 56 can be maintained. This elastic roller 140 functions as an oil applicator to coat the oil on the surface of the fixing belt 38 even in the present eighth embodiment.

In the present eighth embodiment, a cleaning roller 141 formed of a metallic roller to clean the surface of the elastic roller 140 is pressed by a biasing member, not shown, toward the elastic roller 140.

The surface of the cleaning roller 141 may be formed of the metallic material alone as is, but may be coated with fluorine rubber having less releaseability than that of the surface layer (i.e., the semi-transparent film 140) of the elastic roller 140 on its metal surface thereof with a thickness of from 10 to 100 μm. In addition, resins that can be bound with the toner can be coated on the surface of the metallic roller.

With this structure, smears due to toner or paper dust adhered to the elastic roller 140 can be removed by the cleaning roller 141 so that the surface of the elastic roller 140 is cleaned, thereby maintaining the surface of the elastic roller 140 without contamination.

Figure 14:
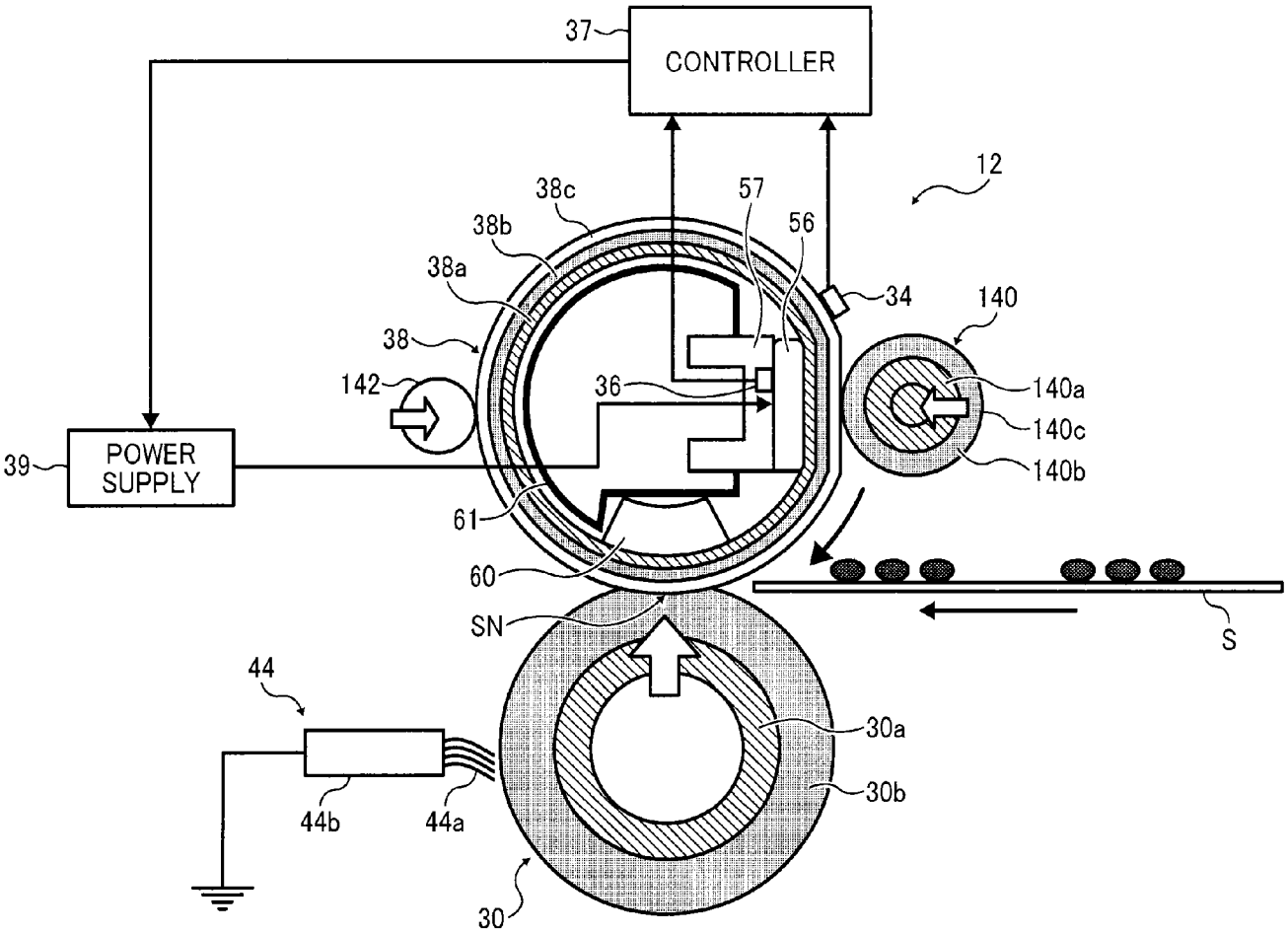
FIG. 14 is a schematic configuration of a fixing device according to a ninth embodiment.

A ninth embodiment will be described referring to FIG. 14. As illustrated in FIG. 14, the fixing device 12 includes the elastic roller 140 configured to press against the fixing belt 38 by being applied with a biasing force by a biasing member, not shown. The elastic roller 140 is disposed opposite the heating member 56 via the fixing belt 38, so as to press-contact the fixing belt 38. With this configuration, even while the fixing belt 38 is rotating, good contact between the fixing belt 38 and the heating member 56 can be maintained. The elastic roller 140 functions as an oil applicator to coat the oil on the surface of the fixing belt 38 even in the present structure.

In the present ninth embodiment, as illustrated in FIG. 14, a cleaning roller 142 configured to clean the surface of the fixing belt 38 is disposed in contact with the fixing belt 38 at a side opposite the elastic roller 140 via the fixing belt 38. The cleaning roller 142 is formed of foamed silicon rubber and preferably includes an uppermost layer formed of a material having less releaseability than that of the surface layer (i.e., the semi-transparent film 140*c*) of the fixing belt 38, for example, conductive PFA.

In the ninth embodiment as illustrated in FIG. 14, the cleaning roller 142 is disposed on the left in the figure; however, the cleaning roller 142 may be disposed above the fixing belt 38. In addition, the cleaning roller 142 being biased by a biasing member, not shown, contacts the fixing belt 38 with pressure.

When the toner image on the sheet S is melted while being crushed on the fixing belt 38, the toner adhered/offset from the sheet S to the fixing belt 38 is attracted to the cleaning roller 142 and is removed from the fixing belt 38. In addition, the adhered/offset toner to the fixing belt 38 is conveyed to the elastic roller 140, and, before adhering to the elastic roller 140, the toner is attracted by the cleaning roller 142 and is removed from the fixing belt 38. Thus, the amount of the offset toner to be adhered to the elastic roller 140 can be reduced. As a result, durability of the elastic roller 140 is improved, and because the offset toner is not developed to agglomerated particles, a quality image is formed on the sheet S.

Figure 15:
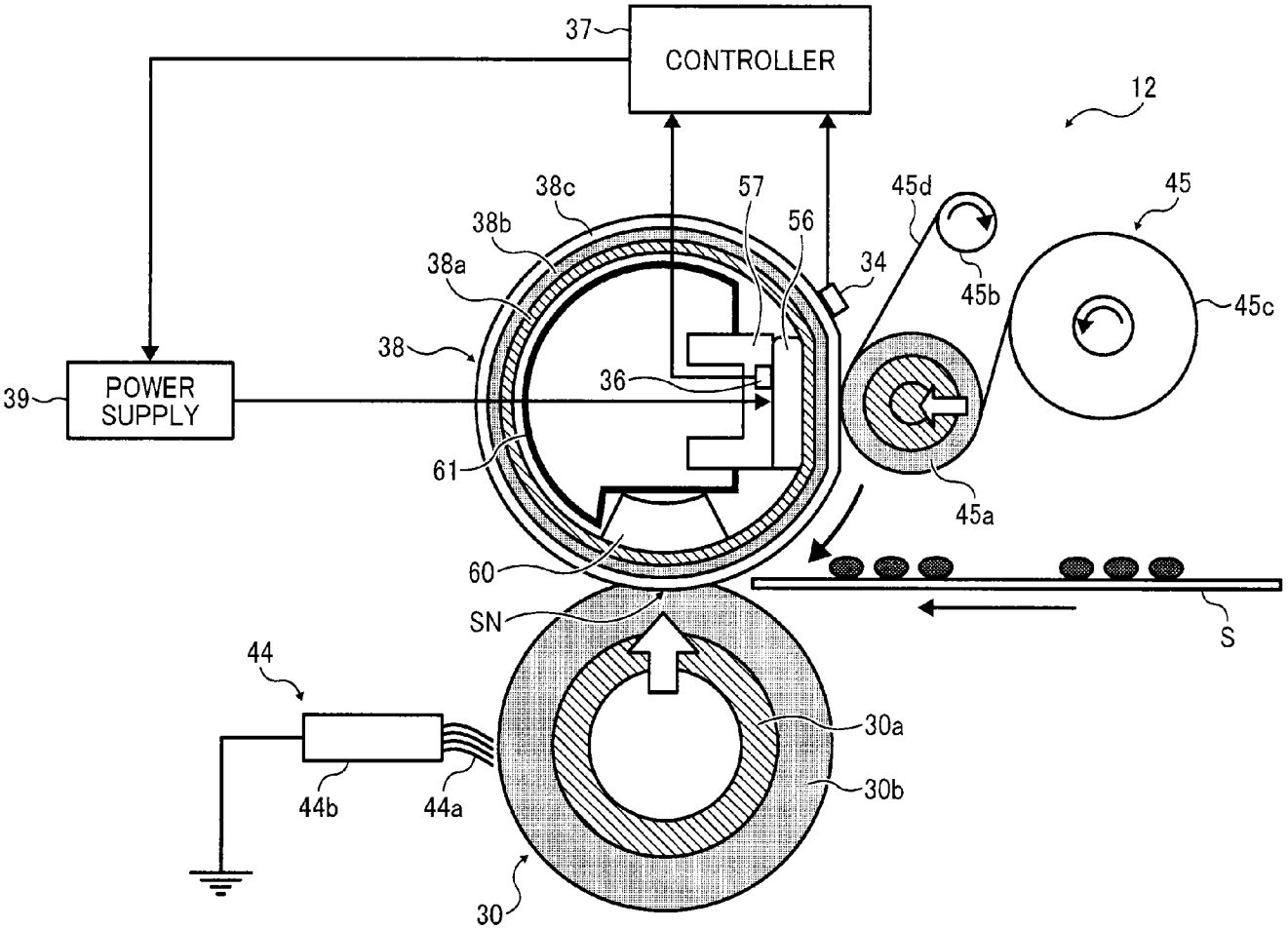
FIG. 15 is a schematic configuration of a fixing device according to a tenth embodiment.

A tenth embodiment according to the present invention will be described referring to FIG. 15. As illustrated in FIG. 15, the fixing device 12 includes a cleaning web unit 45 configured to clean the surface of the fixing belt 38 and coat a release agent thereon.

The cleaning web unit 45 includes a cleaning web 45*d*, a supply roll 45*c*, a wind-up roll 45*b*, and a web pressing roll 45*a*. The supply roll 45*c* supplies the cleaning web 45*d* and the wind-up roll 45*b* winds up the cleaning web 45*d*. The supply roll 45*a* presses the cleaning web 45*d* against the surface of the fixing belt 38. Then, the cleaning web 45*d* moves little by little responsive to the fixing operation while being pressed against the surface of the fixing belt 38 by the web pressing roll 45*a*.

In the present configuration, the web pressing roll 45*a* is positioned opposite the heating member 56 via the fixing belt 38 and the cleaning web 45*d*. Because the web pressing roll 45*a* is biased by a biasing member, not shown, and serves as a pressing member to press against the fixing belt 38. With this configuration, even while the fixing belt 38 is rotating, good contact between the fixing belt 38 and the heating member 56 can be maintained.

Preferred materials for the cleaning web 45*d* include in general aromatic polyamide resins and polyester unwoven fibers. The cleaning web 45*d* includes a release agent such as silicon oil, which is soaked in the cleaning web 45*d*. With this structure, the cleaning web 45*d* applies the release agent to the surface of the fixing belt 38 so that the releaseability of the surface of the fixing belt 38 may be improved, thereby preventing the toner from adhering on the surface of the fixing belt 38 from the sheet S. In addition, when the cleaning web 45*d* slidably contacts the fixing belt 38, the adhered/offset toner on the fixing belt 38 is collected to the cleaning web 45*d*, thereby cleaning the surface of the fixing belt 38.

In addition, in the present tenth embodiment, a conductive layer is coated on the elastic layer 30*b* of the pressure roller 30. The discharging brush 44 is disposed near the pressure roller 30 so as to discharge an electrical charge from the pressure roller 30. As a result, the charged charge of the pressure roller 30 is reduced and the electrical charge difference between the pressure roller 30 and the fixing belt 38 is reduced, so that an electrostatic offset in which the toner is adhered from the sheet S to the fixing belt 38 by an electrostatic force, can be reduced.

Preferred materials for the conductive layer coated on the elastic layer 30*b* of the pressure roller 30 include for example tetrafluoroethylene-perfluoroalkyl vinylether copolymer (PFA) mixed with carbon. By coating the PFA mixed with carbon on the elastic layer 30*b* of the pressure roller 30, the circumferential surface of the pressure roller 30 exerts conductivity. If the surface resistivity of the pressure roller 30 is in a range from $1*10^8\Omega/m^2$ to $1*10^6\Omega/m^2$, it is assumed that the pressure roller 30 has conductivity.

The discharging brush 44 includes an electrode 44*a* and a holder 44*b*. The electrode 44*a* is fixed to the holder 44*b* formed of a conductive material. Preferred materials for the electrode 44*a* include, for example, (1) multiple fiber-like stainless steel bound together; (2) acrylic fiber dispersed with carbon particles in a streak or dyed with copper ions; (3) carbon fiber alone; and (4) conductive unwoven cloth.

The discharging brush 44 is disposed on the left in FIG. 15 so that the electrode 44*a* can contact or be away at a certain distance relative to the circumferential surface of the pressure roller 30. Alternatively, the discharging brush 44 can be disposed in the bottom of the pressure roller 30.

As described above, when the pressure roller 30 is electrically discharged by the discharging brush 44, the electrical charge difference between the pressure roller 30 and the fixing belt 38 is reduced and the amount of toner electrostatically attracted from the sheet S to the fixing belt 38 is reduced, so that the electrostatic offset is reduced. Accordingly, the amount of offset toner to be adhered from the fixing belt 38 to the cleaning web 45*d* can be reduced. As a result, durability of the cleaning web 45*d* is improved, and because the offset toner is not developed to agglomerated particles, a quality image is formed on the sheet S.

Additional modifications and variations of the present invention are possible in light of the above teachings. It is therefore to be understood that, within the scope of the appended claims, the invention may be practiced other than as specifically described herein.

What is claimed is:

1. A fixing device included in an image forming apparatus, comprising:

a rotatable, endless fixing belt;

a rotatable contact member configured to contact a circumferential surface of the fixing belt to form a nip in association with the fixing belt; and a heating member disposed at an interior surface of the fixing belt and configured to heat the fixing belt, the heating member including a plurality of heat sources arranged along a width of the sheet in a direction perpendicular to a sheet conveyance direction; and a controller that controls the heating member to change an area of the fixing belt to be heated by each heat source based on image data and corresponding to an unfixed image on the sheet, wherein the heating member is disposed at a portion of the fixing belt other than the portion of the fixing belt that forms the nip in conjunction with the contact member.

2. The fixing device as claimed in claim 1, wherein an area of contact between the heating member and the fixing belt is a substantially flat plane.

3. The fixing device as claimed in claim 1, wherein the controller controls the heating member to heat the fixing belt such that the temperature of a portion of the fixing belt corresponding to a blank area of the sheet of recording media where no unfixed image exists becomes lower than the temperature of a portion of the fixing belt corresponding to an image area of the sheet of recording media where an unfixed image exists.

4. The fixing device as claimed in claim 1, further comprising a pressure member, wherein the pressure member is disposed at a position opposite the heating member via the fixing belt and away from the contact member, and presses against the fixing belt.

5. The fixing device as claimed in claim 4, wherein the pressure member is an elastic roller rotatably disposed relative to a body of the fixing device.

6. The fixing device as claimed in claim 4, wherein the pressure member is an elastic pad.

7. The fixing device as claimed in claim 4, wherein the pressure member is a brush.

8. The fixing device as claimed in claim 7, wherein the brush member is rotatably disposed relative to the body of the fixing device.

9. The fixing device as claimed in claim 4, further comprising a nip forming member disposed opposite the contact member via the fixing belt so as to form the nip, wherein the pressure member is positioned on a hypothetical line extending from substantially a center of the nip to and substantially a center of the contact member.

10. The fixing device as claimed in claim 9, further comprising a stay, on which the heating member is mounted, wherein the heating member and the nip forming member are supported by the same stay.

11. The fixing device as claimed in claim 4, wherein the pressure member is a release-agent applicator roller configured to coat a release agent on a surface of the fixing belt and disposed rotatably relative to the fixing device.

12. The fixing device as claimed in claim 11, further comprising a cleaning member positioned to clean a surface of the release-agent applicator roller.

13. The fixing device as claimed in claim 11, further comprising a fixing belt cleaner, wherein the fixing belt cleaner is disposed further downstream in the rotary direction of the fixing belt than the nip and further upstream in the fixing belt rotary direction than the release-agent applicator roller.

14. The fixing device as claimed in claim 4, further comprising a cleaning web unit including an elastic web-pressing roll, a cleaning web, a supply roll, and a wind-up roll, wherein the pressure member is the elastic web-pressing roll, the cleaning web moves while being pressed against the surface of the fixing belt by the web-pressing roll, the supply roll supplies the cleaning web, and the wind-up roll winds up the cleaning web.

15. The fixing device as claimed in claim 1, further comprising a belt support member disposed to contact an interior surface of the fixing belt at both lateral ends in the width of the sheet thereof to guide rotation of the fixing belt along a predetermined locus.

16. The fixing device as claimed in claim 1, further comprising a discharger to discharge an electrical charge from the contact member, wherein a conductive layer is coated on a surface of the contact member.

17. An image forming apparatus comprising:

an image carrier;

a toner image forming member to form a toner image on the image carrier;

a transfer member to transfer the toner image from the image carrier to a recording medium; and a fixing device as claimed in claim 1, to fix the toner image onto the recording medium.

* * * * *